US006761338B2

(12) United States Patent
Yamasaki

(10) Patent No.: US 6,761,338 B2
(45) Date of Patent: Jul. 13, 2004

(54) CHUCK STRUCTURE FOR JOINING HEADREST TO WHEELCHAIR

(76) Inventor: Ryuji Yamasaki, 1946-16 Miyanogi-cyo Inage-ku, Chiba (JP)

( * ) Notice: Subject to any disclaimer, the term of this patent is extended or adjusted under 35 U.S.C. 154(b) by 0 days.

(21) Appl. No.: 10/271,894

(22) Filed: Oct. 16, 2002

(65) Prior Publication Data

US 2004/0075030 A1 Apr. 22, 2004

(51) Int. Cl.[7] ..... B68G 5/00
(52) U.S. Cl. ..... 248/118; 280/250.1; 297/DIG. 4
(58) Field of Search ..... 280/250.1, 280.1, 280/304.1; 297/321, DIG. 4, 409, 410; 248/118, 118.3

(56) References Cited

U.S. PATENT DOCUMENTS 3,730,589 A * 5/1973 Lane ..... 142/42
5,308,028 A * 5/1994 Kornberg ..... 248/118
5,967,613 A * 10/1999 McKeever ..... 297/397
6,419,321 B1 * 7/2002 Sack ..... 297/405

FOREIGN PATENT DOCUMENTS

JP 2000-5236 * 1/2000

* cited by examiner

*Primary Examiner*—Ramon O. Ramirez
(74) *Attorney, Agent, or Firm*—Alan D. Kamrath; Nikolai & Mersereau, P.A.

(57) ABSTRACT

A chuck structure joins a headrest to a wheelchair. A chuck includes a joining hole at an upper end serving to install a supporting arm at two sides of the headrest. The lower end of the chuck includes two sidewalls, on the sidewalls being through holes, with the two sidewall forming a recessed space. Inside the recessed space is an arched end face. The recessed space of the chuck is aligned with and fixed to a bend of the armrest of the wheelchair. A positioning member between the through holes on the sidewalls presses against the bottom of the armrest bend. Two ends of the arched end face press against the upper end of the armrest bend, forming firm positioning effect by three points. The headrest installed on the chuck can be assembled or disassembled by tightening or loosening the positioning member.

5 Claims, 5 Drawing Sheets

CHUCK STRUCTURE FOR JOINING HEADREST TO WHEELCHAIR

BACKGROUND OF THE INVENTION (1) Field of the Invention

The invention relates to a chuck structure for joining a headrest to a wheelchair, particularly an innovative design of a chuck structure that enables convenient assembly or disassembly of a headrest onto or from a wheelchair to suit actual circumstances.

(2) Prior Art

Wheelchairs come in two types, with or without a headrest. Though consumers may have the option to purchase either model, they could not have features of both models simultaneously. The model with a headrest generally has the headrest fixed firmly to the framework of the wheelchair, so the consumer could not have the option of removing the headrest to suit different circumstances in use.

To seek improvement, therefore, the inventor has devoted research based on many years of experience in the design and production of related products, and has come up with the present invention of a chuck structure for joining a headrest to a wheelchair.

SUMMARY OF THE INVENTION

The primary objective of the invention is to provide a chuck structure for joining a headrest to a wheelchair. A chuck includes a joining hole at an upper end, serving to install a supporting arm at two sides of the headrests. At a lower end of the chuck are two sidewalls. On the sidewalls are through holes. The two sidewalls form a recessed space. In the recessed space is an arched end face. The recessed space of the chuck is aligned with and fixed into a bend on a push-handle (armrest) of the wheelchair. A positioning member between the through holes on the sidewalls presses against a bottom of the bend on the armrest, and the two ends of the arched end face press against the upper end of the armrest bend, forming a three-point fastening and positioning effect. By tightening or loosening the positioning member, the headrest on the chuck can be conveniently assembled or disassembled.

For better understanding of the structural characteristics, of the approach of the invention, and of the objectives and performance of the present invention, please refer to the following description and drawings.

BRIEF DESCRIPTION OF NUMERALS

Figure 1:
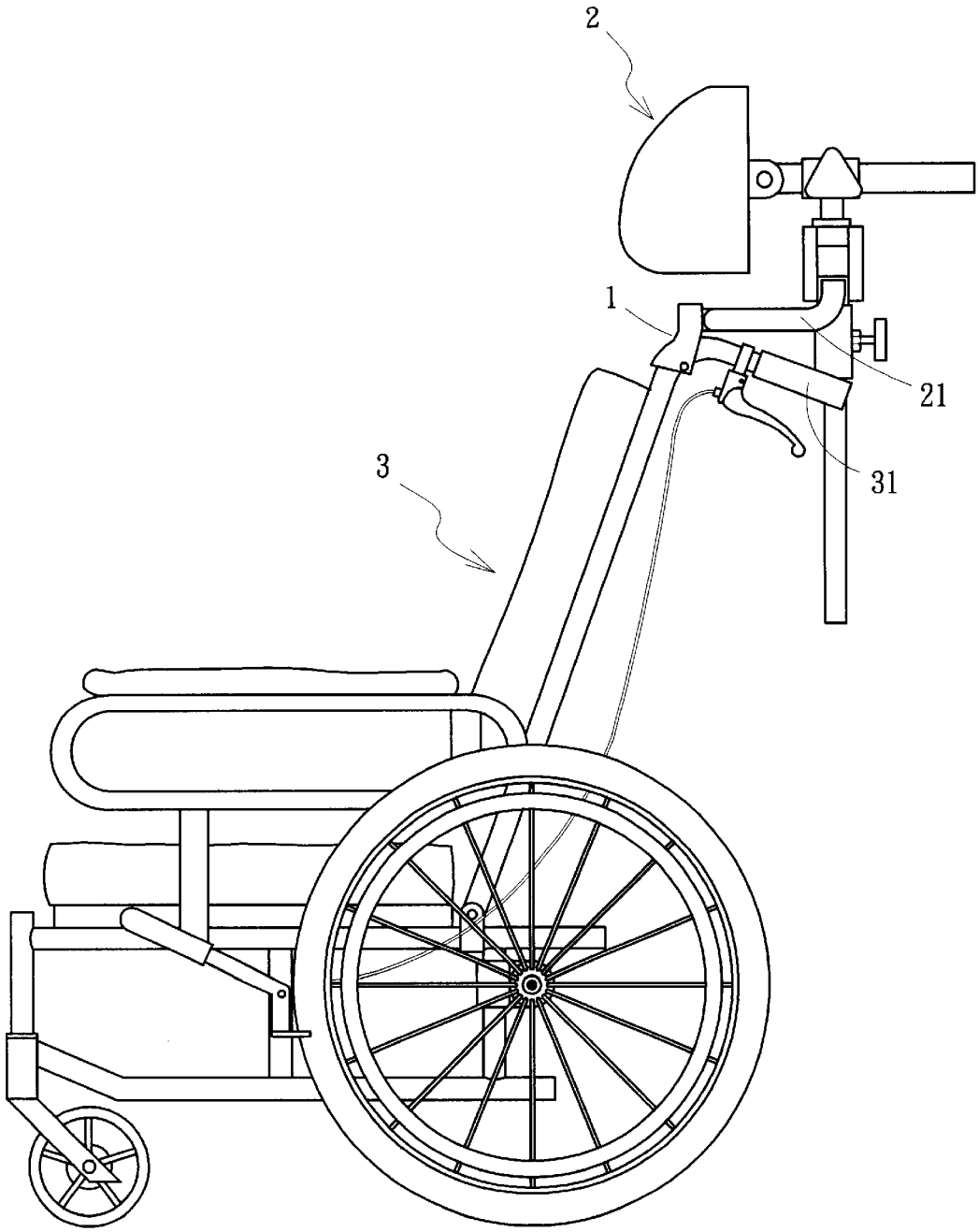
FIG. 1 is a view of the invention connected with a headrest and a wheelchair.

1 chuck
12 connecting unit
131 through hole
15 recessed space
11 joining hole
13 sidewall
14 positioning member
16 arched end face
2 headrest
3 wheelchair
32 bent section
21 supporting arm
31 armrest(push-handle)
17 auxiliary lever

DETAILED DESCRIPTION OF PREFERRED EMBODIMENTS

Figure 2:
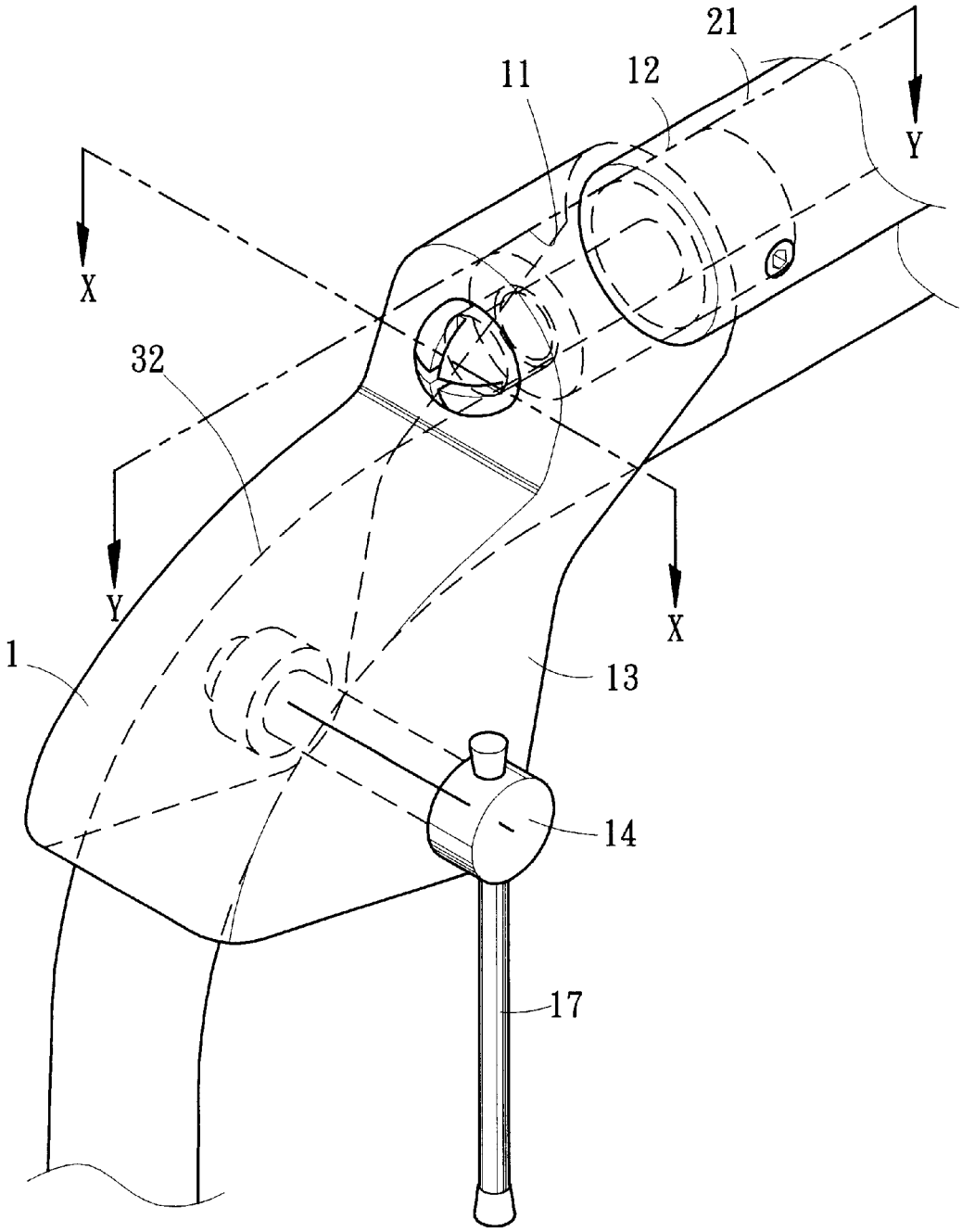
FIG. 2 is a partially perspective view of the invention connected with a headrest and a wheelchair.
Figure 3:
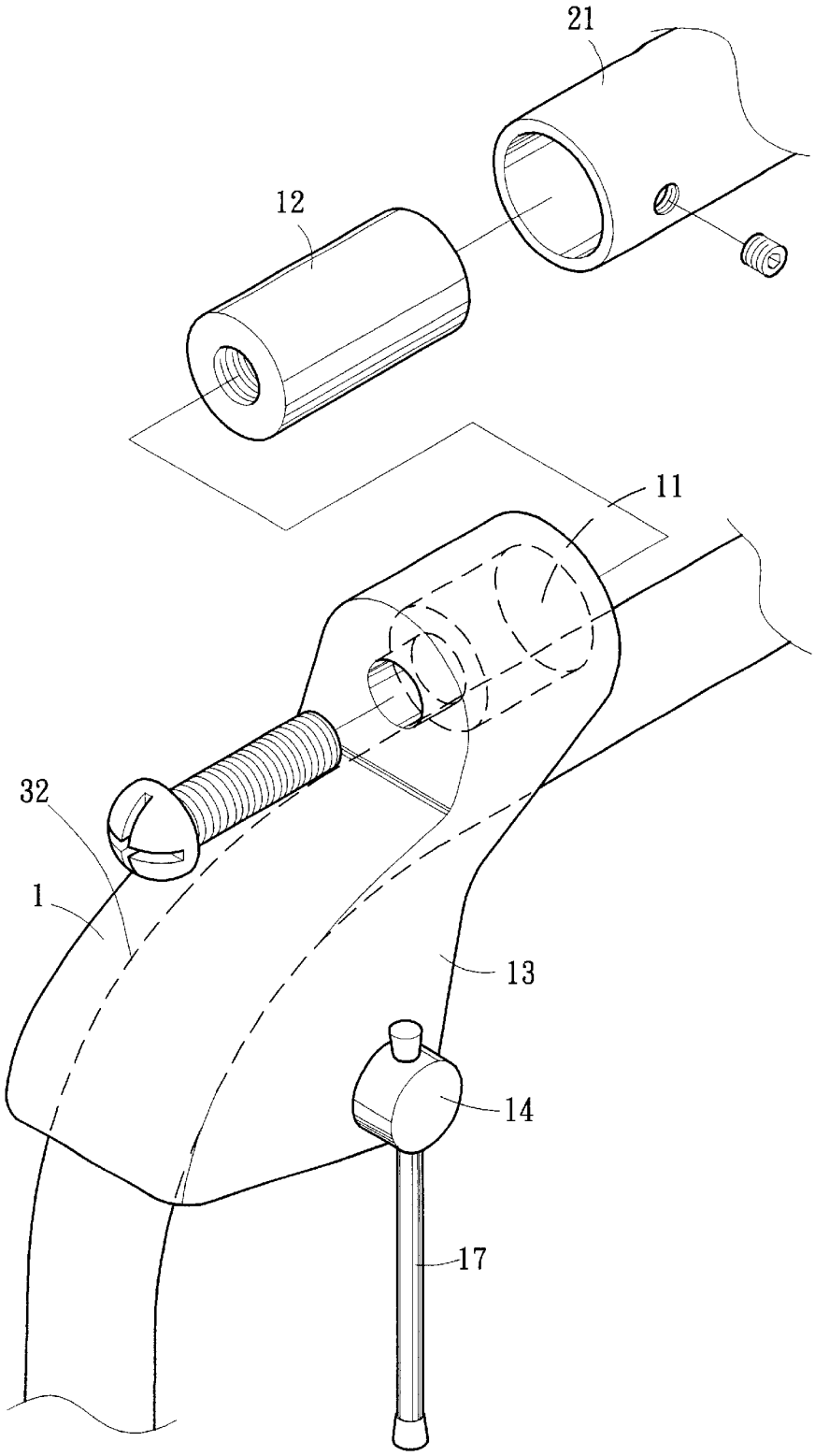
FIG. 3 is a partially exploded view of the invention connected with a headrest and a wheelchair.

As shown in FIGS. 1 to 3, the invention comprises a chuck 1, on a top thereof being a joining hole 11 with a specified number of steps. In the joining hole 11 is inserted an fixed a connecting unit 12. The connecting unit 12 is joined with supporting arms 21 on two sides of the headrest 2. At a lower end of the chuck 1 are two sidewalls 13 (also shown in FIGS. 4 and 5). On each of the sidewalls 13 is respectively a through hole 131 into which is inserted a positioning member 14. The positioning member 14 presses against a bottom of a bent section 32 on an armrest of a wheelchair 3. The positioning member 14 forms a recessed space 15 between the sidewalls 13. The recessed space 15 serves to accommodate the bent section 32 of the armrest 31 of the wheelchair 3, which is pressed tightly by the sidewalls 13 and the bent section 32. Inside the recessed space 15 is an arched end face 16. The arched end face 16 has curvature smaller than a curvature of the bent section 32 of the wheelchair 3, for the purpose that when the bent section 32 is inserted in the recessed space 15, two ends of the arched end face 16 are pressed against an end face of the bent section 32.

Figure 4:
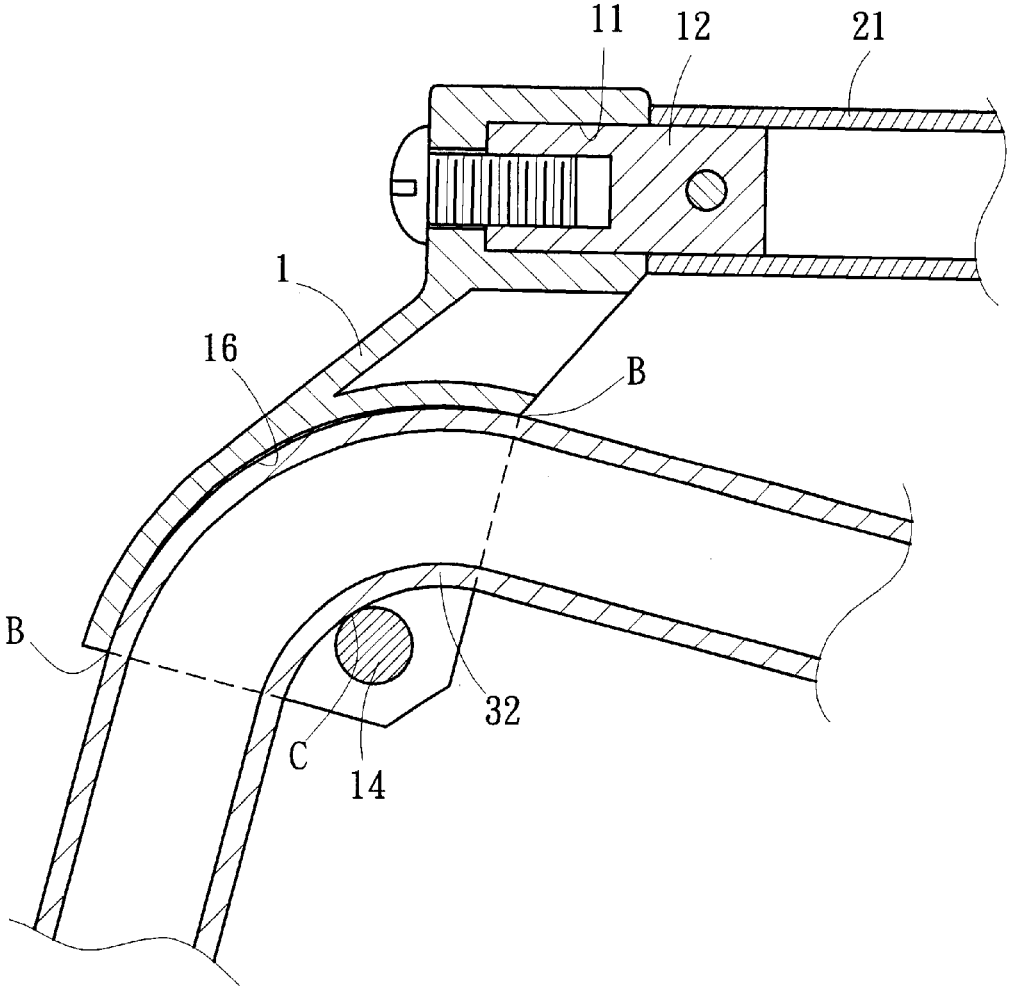
FIG. 4 is a section view of the invention taken along Y—Y in FIG. 2.
Figure 5:
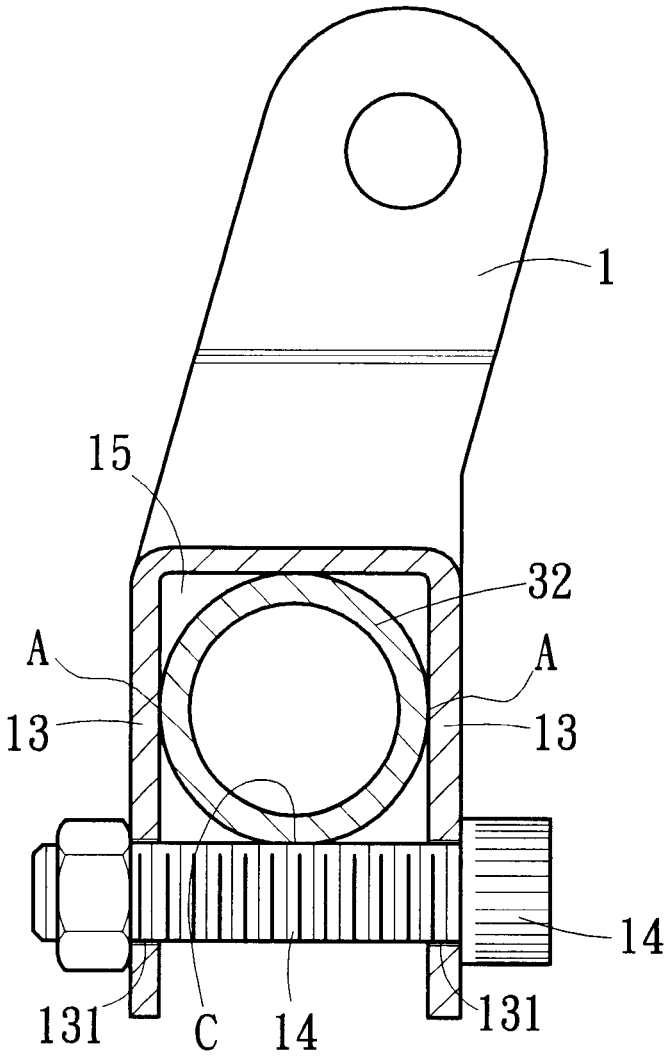
FIG. 5 is a section view of the invention taken along X—X in FIG. 2.

Since the sidewalls 13 of the chuck 1 and two sides of the bent section 32 form a clamp point A (shown in FIG. 5) when the headrest 2 and the supporting arm 21 of the chuck 1 are embedded in the bent section 32 of the wheelchair 3, two ends of the arched end face 16 inside the recessed space 15 also presses against two ends of the bent section 32 forming a clamp point B (shown in FIG. 4). The positioning member 14 penetrating through the through hole 131 on the sidewall 13 presses against the lower end of the bent section 32 to create a supporting point. Thus, the chuck 1 can be firmly fixed at the bent section 32, enabling firm assembly of the headrest 2 and the wheelchair 3.

Furthermore, at one end of the positioning member 14 is installed an auxiliary lever 17 (shown in FIG. 2). This auxiliary lever 17 serves to help tighten or loosen the positioning member 14, so the consumer can disassemble the chuck 1 without the need of additional tools.

To sum up, the present invention is capable of achieving the anticipated performance described above, the physical construction disclosed above is not yet seen in similar products, nor used in public before the application. Therefore, this application is filed according to the patent law. Your favorable consideration shall be appreciated.

What is claimed is:

1. A chuck structure for joining a headrest to a wheelchair, the chuck structure being positioned on a bent section on each armrest on two sides of the wheelchair, comprising: a chuck, and a headrest; an end of a supporting arm used to support the head rest being fixed to the chuck, the chuck being fixed to the bent section, on the chuck is a joining hole in connection with the supporting arm, at a lower end of the chuck being a recessed space formed between two sidewalls, the sidewalls serving to press the bent section, the sidewalls leaning on the bent section and forming an arched face, with two ends of the chuck being tightly in contact with two sides on the top of the bent section; and a positioning member penetrating through the two sidewalls, the positioning member pressing in middle of a lower part of the bent section, thereby the chuck is firmly and steadily fixed at the bent section, and the headrest is firmly joined to the wheelchair.

2. The chuck structure claim 1, wherein the joining hole on the chuck has steps.

3. The chuck structure of claim 1, wherein in the joining hole is inserted and fixed a connecting unit for connection with the supporting arm.

4. The chuck structure of claim 1, wherein the arched end face has a curvature that is smaller than a curvature of the bent section of the wheelchair.

5. The chuck structure of claim 1, wherein at one end of the positioning member is installed an auxiliary lever, the auxiliary lever serving to help tighten or loosen the positioning member.

* * * * *